United States Patent [19]

Gelin

[11] Patent Number: 4,460,235

[45] Date of Patent: Jul. 17, 1984

[54] ADAPTER FOR A FEMALE ELECTRICAL CONNECTOR

[75] Inventor: Claude Gelin, Créteil, France

[73] Assignee: CGEE Alsthom, Levallois-Perret, France

[21] Appl. No.: 394,008

[22] Filed: Jun. 30, 1982

[30] Foreign Application Priority Data

Jun. 30, 1981 [FR] France ..... 81 12870

[51] Int. Cl.[3] ..... H01R 13/50

[52] U.S. Cl. ..... 339/154 R; 339/272 A; 339/176 MP

[58] Field of Search ..... 339/17 L, 17 LC, 17 M, 339/17 LM, 198 R, 198 G, 198 S, 176 MP, 272 R, 272 A, 272 UC, 92, 154 R, 154 A, 156 R; 361/413, 426

[56] References Cited

U.S. PATENT DOCUMENTS

| | | | |
|---|---|---|---|
| 2,953,767 | 9/1960 | Jackson et al. | 339/92 M |
| 3,296,576 | 1/1967 | Motten | 339/272 R |
| 3,671,918 | 6/1972 | Mitchell | 339/157 R |
| 3,870,839 | 3/1975 | Almich et al. | 339/17 LC |
| 3,930,706 | 1/1976 | Obuch et al. | 339/272 R |
| 4,082,407 | 4/1978 | Smorzaniuk et al. | 339/17 M |
| 4,174,147 | 11/1979 | Waddington et al. | 339/176 MP |
| 4,239,324 | 12/1980 | Stenz | 339/198 G |
| 4,385,791 | 5/1983 | Lovrenich | 339/198 R |
| 4,401,357 | 8/1983 | Dvorachek | 339/272 R |

FOREIGN PATENT DOCUMENTS

| | | |
|---|---|---|
| 17940 | 10/1980 | European Pat. Off. . |
| 417402 | 2/1921 | Fed. Rep. of Germany . |
| 2276758 | 6/1975 | France . |
| 2448235 | 8/1980 | France . |

OTHER PUBLICATIONS

Siemens Zeitschrift vol. 34, No. 4, Apr. 1960, Erlangen (DE), M. Bremberger, "Steckverbindungen fur Gedruckte Schaltungen", p. 251.

*Primary Examiner*—Eugene F. Desmond
*Assistant Examiner*—David L. Pirlot
*Attorney, Agent, or Firm*—Sughrue, Mion, Zinn, Macpeak and Seas

[57] ABSTRACT

The female electrical connector (4) is intended to mate with a corresponding male electrical connector (2) fixed to a printed circuit board (1), and comprises a moulded body having a plurality of sockets (6) for receiving female spring blade contacts (7) each having a connection tail (8) for crimping to electrical conductors. The adapter (5) comprises a moulded body which fits on and is fixed to said female connector, and which houses a plurality of screw terminals (12). Each screw terminal is connected via a corresponding tongue (9, 10 or 11) to the contact tail of a corresponding one of the female spring blade contacts. The tongues are soldered to the connection tails. The screw contacts are capable of receiving at least two electrical conductors (17) of total cross section not less than 1.5 mm$^2$.

3 Claims, 4 Drawing Figures

ADAPTER FOR A FEMALE ELECTRICAL CONNECTOR

The present invention relates to an adapter for a female electrical connector of the kind that is used to mate with a male connector on a printed circuit board.

BACKGROUND OF THE INVENTION

Industrial installations that make use of electronic automation systems tend to comprise enclosed racks in which printed circuit cards are mounted. Cables from the controlled equipment are brought into the housing enclosing the rack and are releasably plugged onto connectors at the visible edges of the printed circuit cards.

As with many other kinds of equipment, such connectors are standardised, and in practice the use of standardised equipment is often unavoidable, even when the standard is not particularly well adapted to requirements. For connectors on the edges of printed circuit boards of the kind envisaged, the German DIN standard has become very widely used. On the printed circuit, such a connector comprises a male portion having a moulded body housing L-shaped contact pins having one end soldered to the board and the other end projecting parallel to its plane. The connector is fixed to the card on one side of its most accessible edge, and the pins point to, or extend beyond said edge. A corresponding female connector comprises a body likewise made of moulded material and housing female contacts that mate releasably with said pins. Wires are connected to the non-mating ends of said female contacts by crimping the wires in a tail provided for the purpose. The standard contacts are so dimensioned that they can be crimped only to one or two wires of not more than 0.5 $mm^2$ cross section. Unfortunately, the wires leading to said controlled equipment are very often 1.5 $mm^2$ in cross section, which makes it impossible to connect them directly to a standard female connector. Some kind of interface or adapter is required, and one frequently used interface comprises a a terminal strip having a set of screw terminals large enough to receive said 1.5 $mm^2$ wires connected to a set of 0.5 $mm^2$ wires that in turn are crimped to the standard female contacts.

The present invention provides an improved adapter to perform the above-mentioned connection of a 1.5 $mm^2$ section wire to a DIN standard female contact which is capable, in theory, only of being crimped to wires of not more than 0.5 $mm^2$ section. The invention is particularly applicable to female connectors in accordance with the standard DIN 41612 form E.

SUMMARY OF THE INVENTION

The present invention provides an adapter for a female electrical connector intended to mate with a corresponding male electrical connector fixed to a printed circuit board, the female connector comprising a moulded body having a plurality of sockets for receiving female spring blade contacts having a connection tail for crimping to electrical conductors, wherein the adapter comprises a moulded body which fits on and is fixed to said female connector, said adapter body housing a plurality of screw terminals and each screw terminal being connected via a corresponding tongue to the contact tail of a corresponding one of the female spring blade contacts, said tongues being soldered to the connection tails, and said screw contacts being capable of receiving at least two electrical conductors of total cross section not less than 1.5 $mm^2$.

In one embodiment of the invention the screw terminals are disposed to receive the conductors end on while the screws are disposed to receive a screw-driver sideways on.

In another embodiment of the invention the screw terminals are disposed to receive the conductors sideways on while the screws are disposed to receive a screw-driver end on.

BRIEF DESCRIPTION OF THE DRAWINGS

Two embodiments of the invention are described by way of example with reference to the accompanying drawings, in which:

FIG. 1 is an exploded perspective view of a first connector and adapter assembly for receiving conductors end on;

FIG. 3 is an exploded perspective view of a second connector and adapter assembly for receiving conductors sideways on.

MORE DETAILED DESCRIPTION

Figure 1:
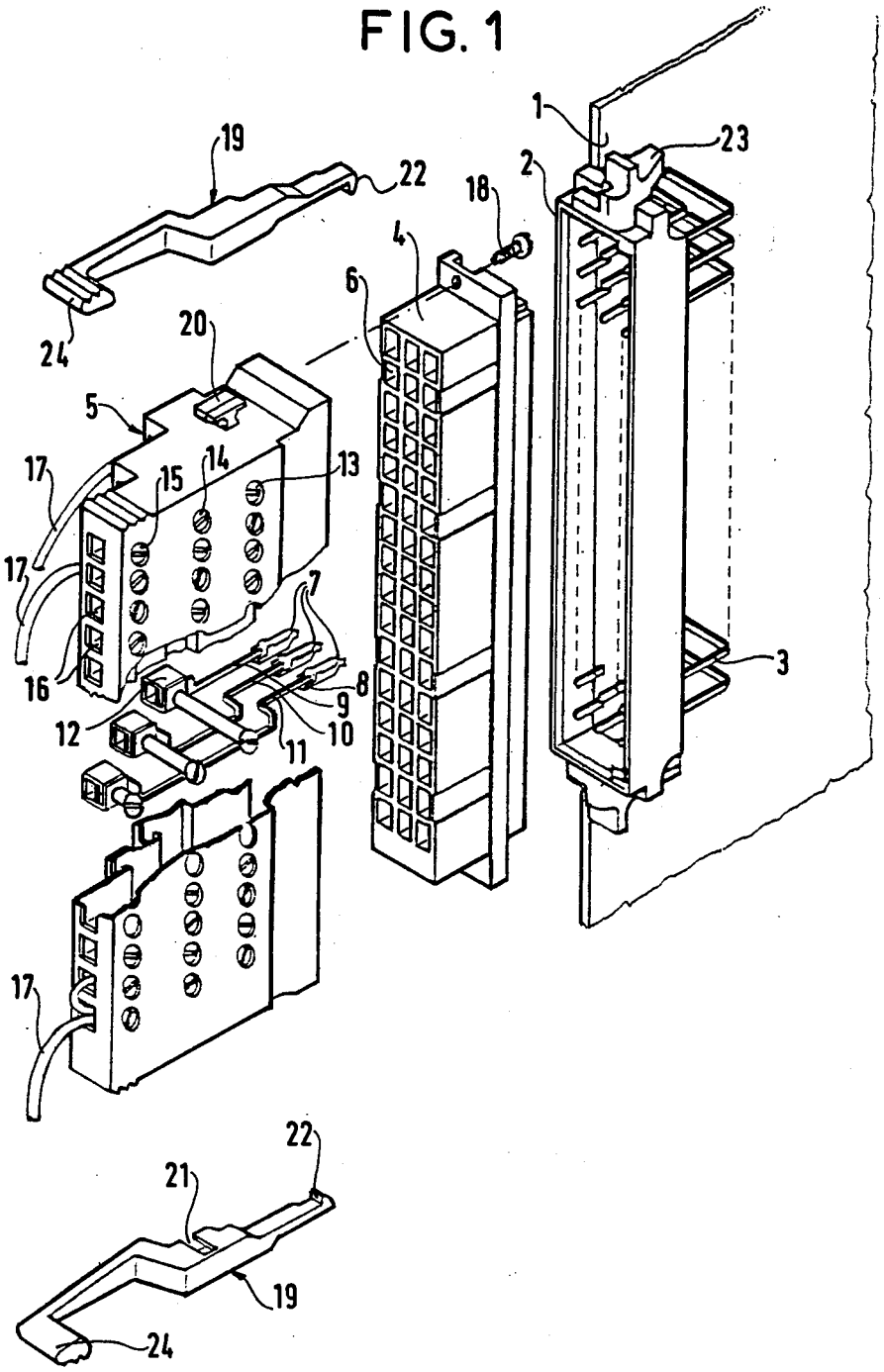

FIG. 1 shows an exploded perspective view of a connector for a printed circuit card 1. The assembly comprises a male connector 2 having forty-eight contact pins 3, a female connector 4 and an adapter 5 in accordance with the invention. The male connector 2 is fixed on one side of the card 1 and the pins 3 are soldered thereto at their printed circuit ends. The female connector is made of moulded material and has forty-eight sockets 6 arranged in three columns of sixteen, and which normally contain female contacts as laid by DIN standard n° 41612. These contacts would be rather like the contacts referenced 7 in FIG. 2. The standard contacts have a tail 8 capable of having not more than two wires of 0.5 $mm^2$ cross section crimped thereto.

In the present invention, the adapter 5 is attached to the standard female connector 4 and brings out the contacts into three columns of screw terminals each capable of receiving at least two conductors of not less than 1.5 $mm^2$ cross section. In the embodiment shown in FIGS. 1 and 2, the columns of screw terminals are staggered, and are connected to the female connectors 7 of respective sockets 6 by soldering a tongue 9, 10 or 11 to the tail 8 of each female connector 7 instead of crimping the tail over a small section wire. Tongues of different lengths are fitted to the three different connectors in each row, with the tongues 9 being the shortest and the tongues 11 being the longest. The ends of the tongues are fitted with screw terminals comprising a clamp 12 having a screw-driven shoe. The screws are of different lengths, with the longest screws 13 being fitted to the terminals on the ends of the shortest tongues 9, middle length screws 14 on middle length tongues 10, and the shortest screws on the longest tongues 11. The net result is three staggered columns of screw terminals having sockets 16 for receiving larger diameter wires 17 end on, with the corresponding screws being disposed in three columns up the flank of the adapter 5.

The adapter body fits over the female connector 4 and is fixed thereto by two screws 18 (only one of which is visible in the figures).

The female connector 4 with the adapter 5 fitted thereto is releasably connectable to the male connector 2. Two levers 19 are provided for locking the female connector assembly to the male connector 2. Each lever 19 is fixed to the adapter 5 by means of a T-shaped cleat 20 projecting vertically from the adapter 5 and fitting in a notch 21 in the lever 19. Each lever 19 has a latching hook 22 at one end which snaps resiliently into a receptacle 23 on the male connector body when the female connector is fitted thereto. The opposite ends 24 of the levers 19 have finger grip ridges to facilitate unlocking the connector by moving the ends 24 towards each other, thereby rocking the levers 19 about the cleats 20 and disengaging the latching hooks 22 from the receptacles 23.

Figure 2:
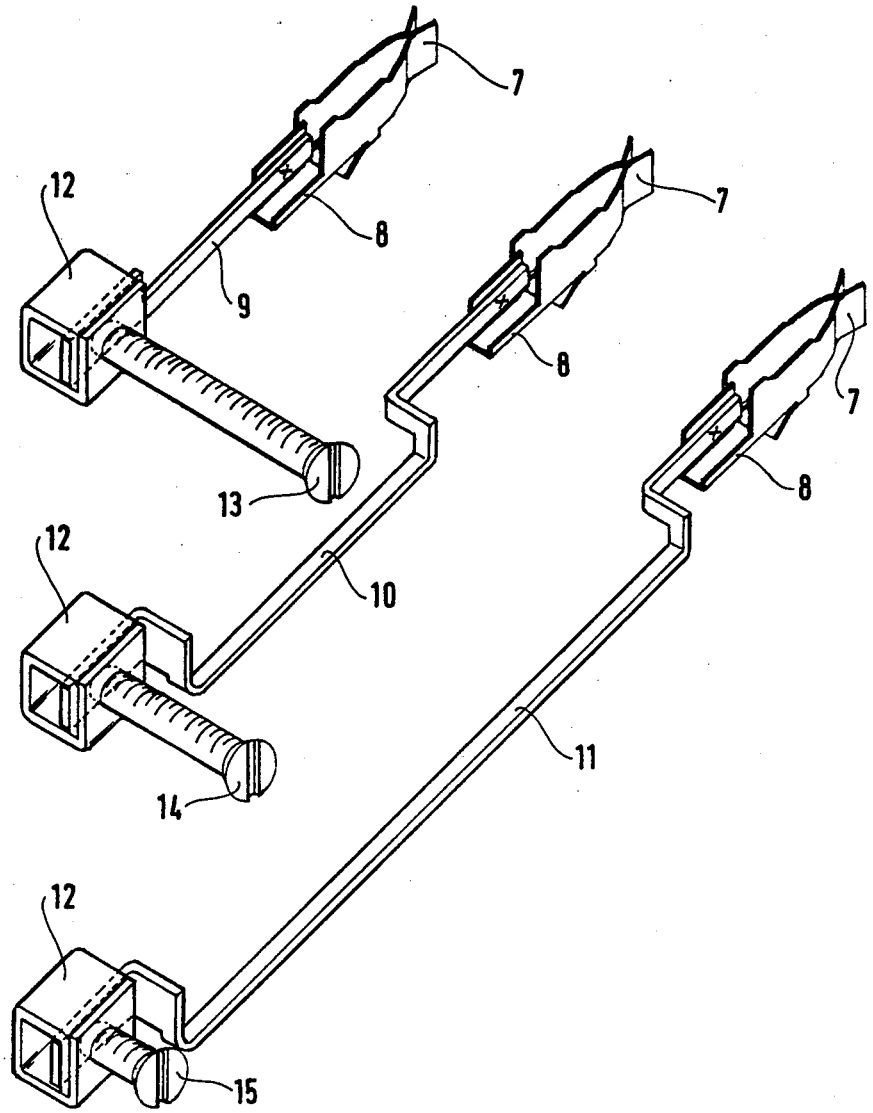
FIG. 2 is a perspective view of female contacts used in the FIG. 1 embodiment.
Figure 3:
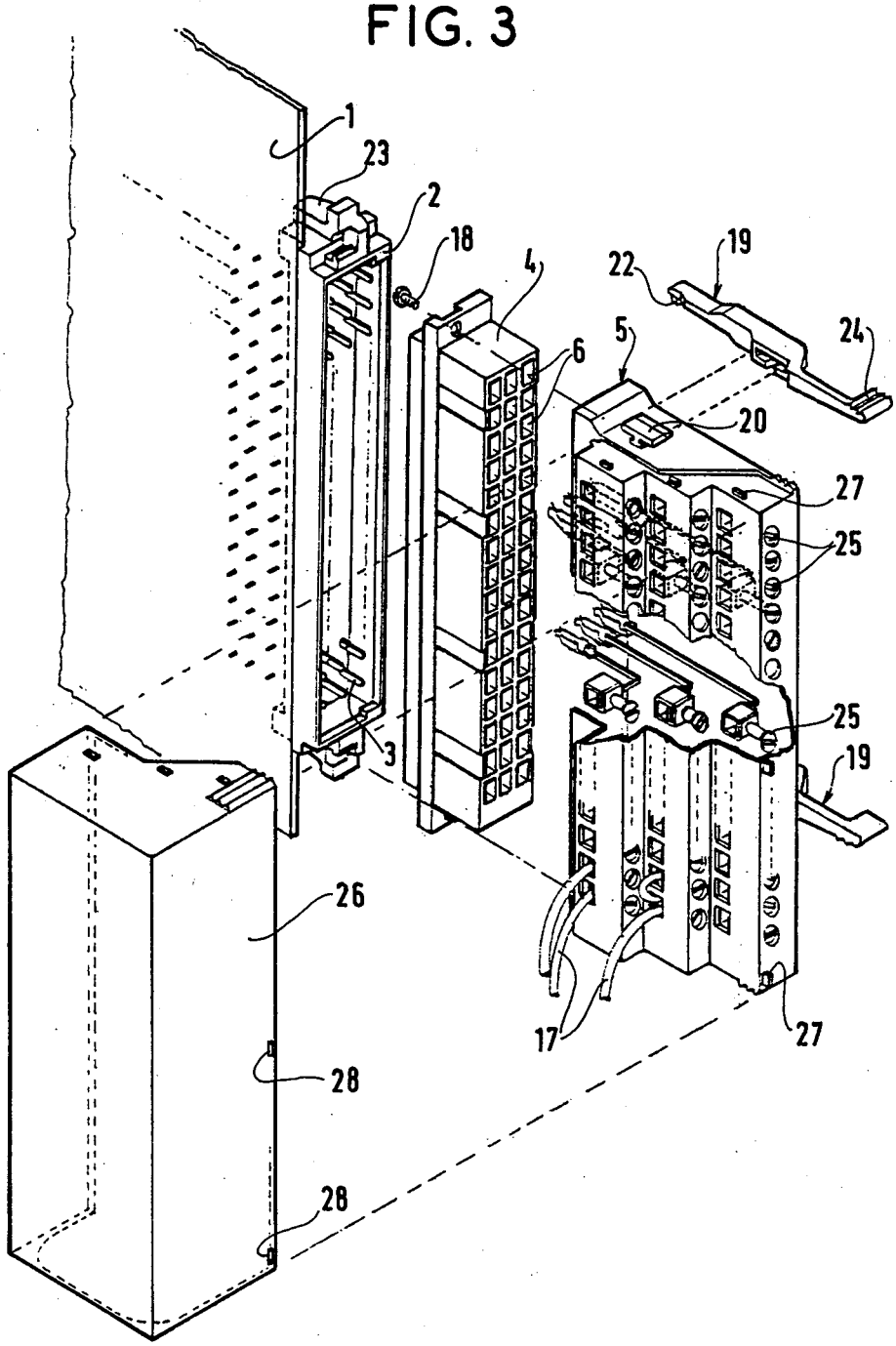
Figure 4:
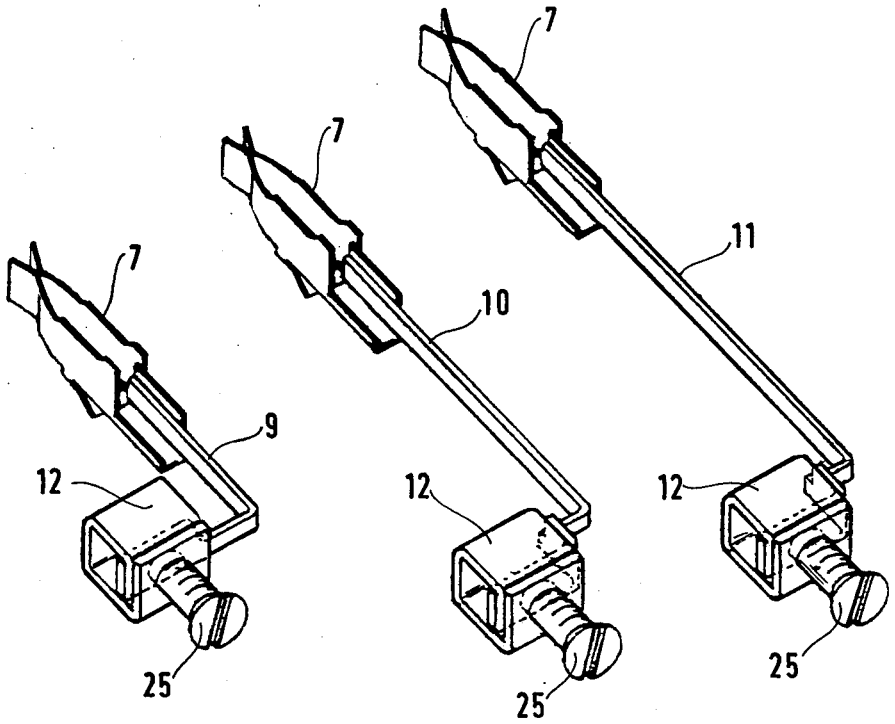
FIG. 4 is a perspective view of female contacts used in the FIG. 3 embodiment.

FIGS. 3 and 4 show a second embodiment of the invention in similar perspective views to FIGS. 1 and 2 respectively, but as seen from the other side in each case. The two embodiments are very similar, and differ mainly in the disposition of the screw terminals, which are arranged for receiving wires 17 from the side and have their screws arranged to receive a screw driver end on. In this case the screws 25 are all the same length, and the shape of the tongues 9, 10 and 11 is slightly modified as a consequence. Another difference is the provision of a cover 26 which clips over the wires 17 entering the adapter 5 by means of lugs 27 on the adapter 5 engaging holes 28 in the cover.

I claim:

1. In combination, an adapter and a female electrical connector, said female electrical connector intended to mate with a corresponding male electrical connector fixed to a printed circuit board, said female connector comprising a moulded body having a plurality of sockets, female spring blade contacts mounted respectively within said sockets, said female spring blade contacts having a connection tail, said adapter comprising a moulded body fit on and being fixed to said female connector, said adapter body housing a plurality of screw terminals, each screw terminal being connected via a corresponding tongue to the contact tail of a corresponding one of said female spring blade contacts, said tongues being soldered to the connection tails, and said screw contacts being capable of receiving at least two electrical conductors of total cross section not less than 1.5 $mm^2$.

2. The adapter and female electrical connector according to claim 1, wherein the screw terminals are disposed to receive the conductors end on, and the screws are disposed to receive a screw-driver sideways on.

3. The adapter and female electrical connector according to claim 1, wherein the screw terminals are disposed to received the conductors sideways on, and the screws are disposed to receive a screw-driver end on.

* * * * *